US008757111B2

(12) United States Patent
Zahdeh et al.

(10) Patent No.: US 8,757,111 B2
(45) Date of Patent: Jun. 24, 2014

(54) ENGINE ASSEMBLY INCLUDING COOLING SYSTEM

(75) Inventors: Akram R. Zahdeh, Rochester Hills, MI (US); Kevin M. Luchansky, Sterling Heights, MI (US); Jan Andrzej Gatowski, Beverly Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 209 days.

(21) Appl. No.: 13/070,809

(22) Filed: Mar. 24, 2011

(65) Prior Publication Data

US 2012/0240876 A1 Sep. 27, 2012

(51) Int. Cl.
*F01P 7/14* (2006.01)
*F02F 1/14* (2006.01)

(52) U.S. Cl.
USPC ..... 123/41.74; 123/41.1; 123/41.78; 123/41.28; 123/41.58; 123/41.01

(58) Field of Classification Search
USPC ..... 123/41.01, 41.08, 41.72, 41.74, 41.1, 123/41.05, 41.02, 41.28–41.29, 41.67, 123/41.78
See application file for complete search history.

(56) References Cited

U.S. PATENT DOCUMENTS

| | | | | |
|---|---|---|---|---|
| 2,713,332 | A * | 7/1955 | Beardsley | 123/41.28 |
| 4,590,894 | A * | 5/1986 | Ishida et al. | 123/41.74 |
| 4,730,579 | A * | 3/1988 | Yamada et al. | 123/41.82 R |
| 6,325,026 | B1 * | 12/2001 | Suzuki | 123/41.1 |
| 6,997,144 | B2 * | 2/2006 | Sugano et al. | 123/41.82 R |
| 7,225,766 | B2 | 6/2007 | Zahdeh | |

FOREIGN PATENT DOCUMENTS

JP 02259227 A * 10/1990 ..... F01P 5/02

* cited by examiner

*Primary Examiner* — Lindsay Low
*Assistant Examiner* — Kevin Lathers
(74) *Attorney, Agent, or Firm* — Harness, Dickey & Pierce, P.L.C.

(57) ABSTRACT

An engine assembly includes a coolant pump, an engine structure, a radiator supply feed and a radiator bypass feed. The engine structure defines a first set of cylinders, a first coolant return gallery and a first cooling jacket. The first coolant return gallery extends in a longitudinal direction from a first longitudinal end to a second longitudinal end of the engine structure. The first cooling jacket is in communication with the coolant pump and with the first coolant return gallery. The first coolant return gallery forms a radiator bypass passage providing the coolant fluid to the coolant pump and bypassing the radiator during a first operating condition and forms a radiator supply passage providing the coolant fluid to the radiator during a second operating condition.

7 Claims, 4 Drawing Sheets

ENGINE ASSEMBLY INCLUDING COOLING SYSTEM

FIELD

The present disclosure relates to engine cooling systems, and more specifically radiator bypass arrangements in engine cooling systems.

BACKGROUND

This section provides background information related to the present disclosure which is not necessarily prior art.

Internal combustion engines may combust a mixture of air and fuel in cylinders and thereby produce drive torque. Combustion of the air-fuel mixture generates heat. An engine cooling system provides fluid flow to dissipate engine heat.

SUMMARY

An engine assembly may include a coolant pump, an engine structure, a radiator supply feed and a radiator bypass feed. The coolant pump may be in communication with a coolant fluid and may include a pump inlet and a pump outlet. The engine structure may define a first set of cylinders, a first coolant return gallery and a first cooling jacket. The first coolant return gallery may extend in a longitudinal direction from a first longitudinal end of the engine structure to a second longitudinal end of the engine structure. The first cooling jacket may be associated with the first set of cylinders and may include a first cooling jacket inlet in communication with the pump outlet and a first cooling jacket outlet in communication with the first coolant return gallery. The radiator supply feed may be in communication with the first coolant return gallery and may be configured to provide the coolant fluid to a radiator. The radiator bypass feed may be in communication with the first coolant return gallery and a pump inlet. The first coolant return gallery may form a radiator bypass passage providing the coolant fluid to the coolant pump and bypassing the radiator during a first operating condition and may form a radiator supply passage providing the coolant fluid to the radiator during a second operating condition.

In another arrangement, an engine assembly may include a coolant pump, an engine structure, a radiator supply feed and a radiator bypass feed. The coolant pump may be in communication with a coolant fluid and may include a pump inlet and a pump outlet. The engine structure may define a first set of cylinders, a first coolant return gallery and a first cooling jacket. The first coolant return gallery may extend longitudinally within the engine structure and may define a first longitudinal end and a second longitudinal end opposite the first longitudinal end. The first cooling jacket may be associated with the first set of cylinders and may include a first cooling jacket inlet in communication with the pump outlet and a first cooling jacket outlet in communication with the first coolant return gallery. The radiator supply feed may be located at the second longitudinal end of the first coolant return gallery. The radiator bypass feed may be located at the first longitudinal end of the first coolant return gallery.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
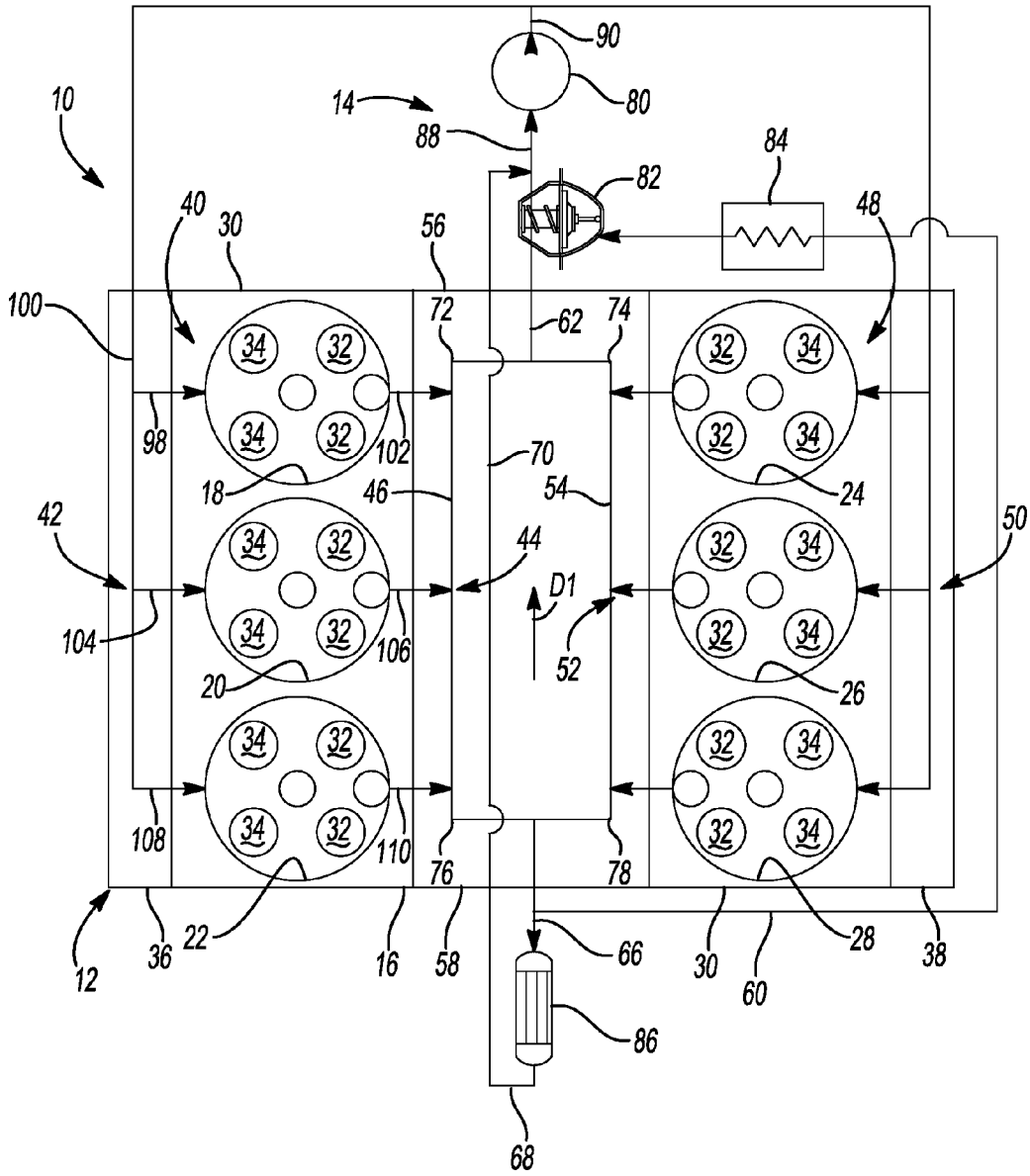
FIG. 1 is a schematic illustration of an engine assembly during a first operating condition according to the present disclosure.
Figure 2:
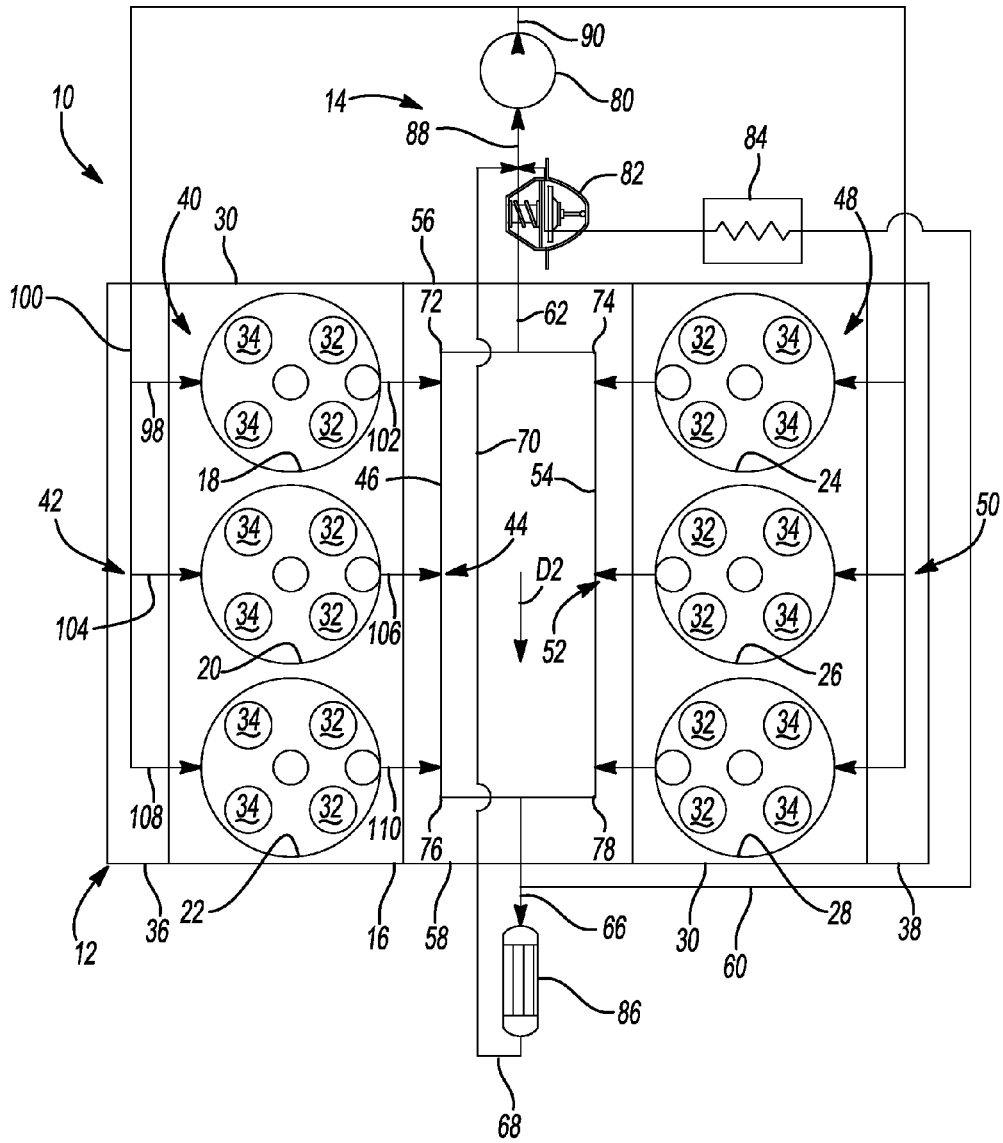
FIG. 2 is an schematic illustration of the engine assembly of FIG. 1 during a second operating condition.

An engine assembly 10 is illustrated in FIGS. 1 and 2. The engine assembly 10 may include an engine structure 12 and a cooling system 14. The engine structure 12 may include an engine block 16 defining cylinders 18, 20, 22, 24, 26, 28 and cylinder heads 30 defining intake ports 32 and exhaust ports 34. In the present non-limiting example, the engine assembly 10 is illustrated as a V6 arrangement including a first bank 36 defining a first set of cylinders 18, 20, 22 and a second bank 38 defining a second set of cylinders 24, 26, 28.

While illustrated in combination with a V6 engine, the present disclosure applies to any number of piston-cylinder arrangements and a variety of reciprocating engine configurations including, but not limited to, V-engines, inline engines, and horizontally opposed engines, as well as both overhead cam and cam-in-block configurations.

Figure 3:
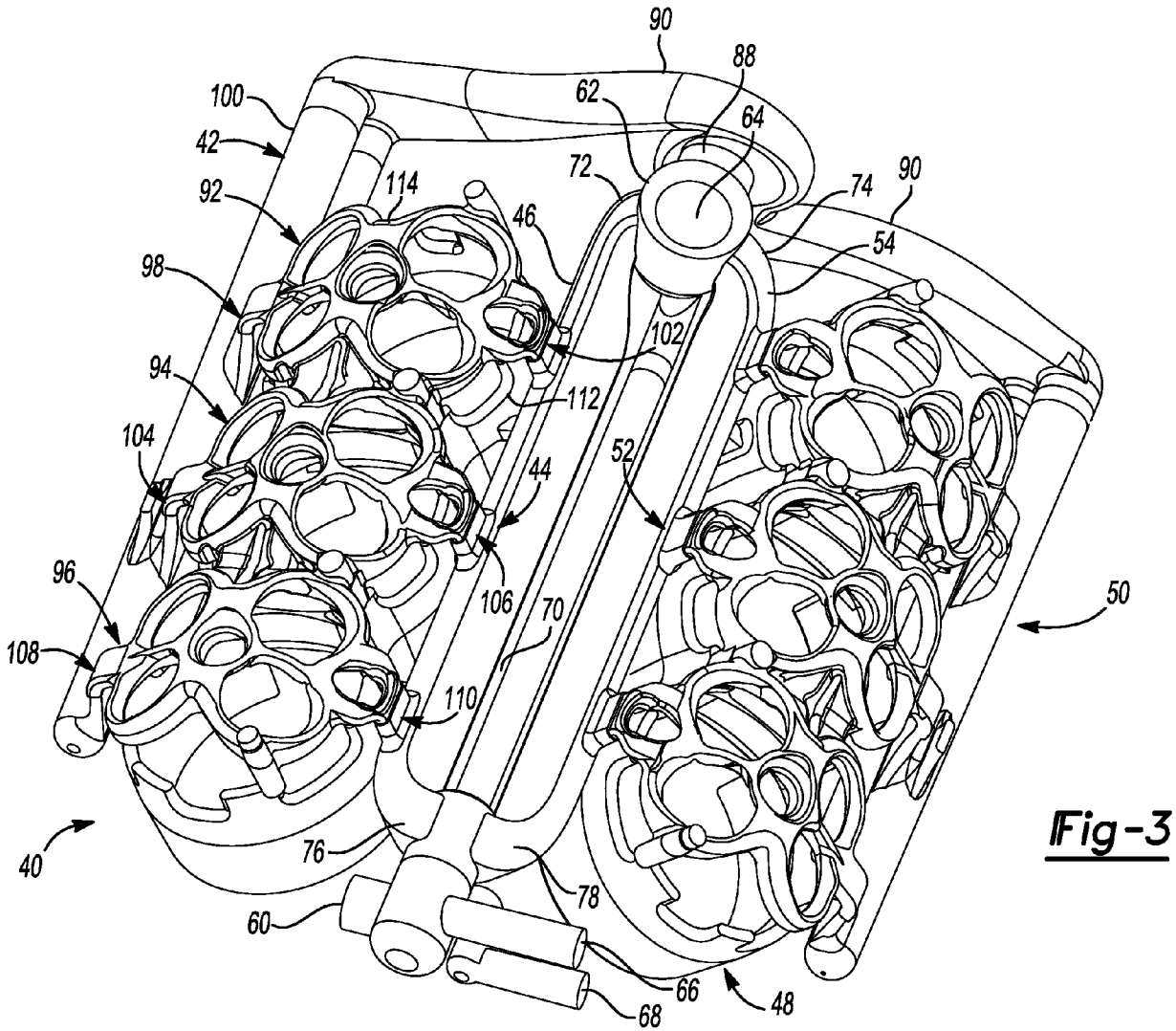
FIG. 3 is an illustration of coolant passages in the engine assembly of FIG. 1.
Figure 4:
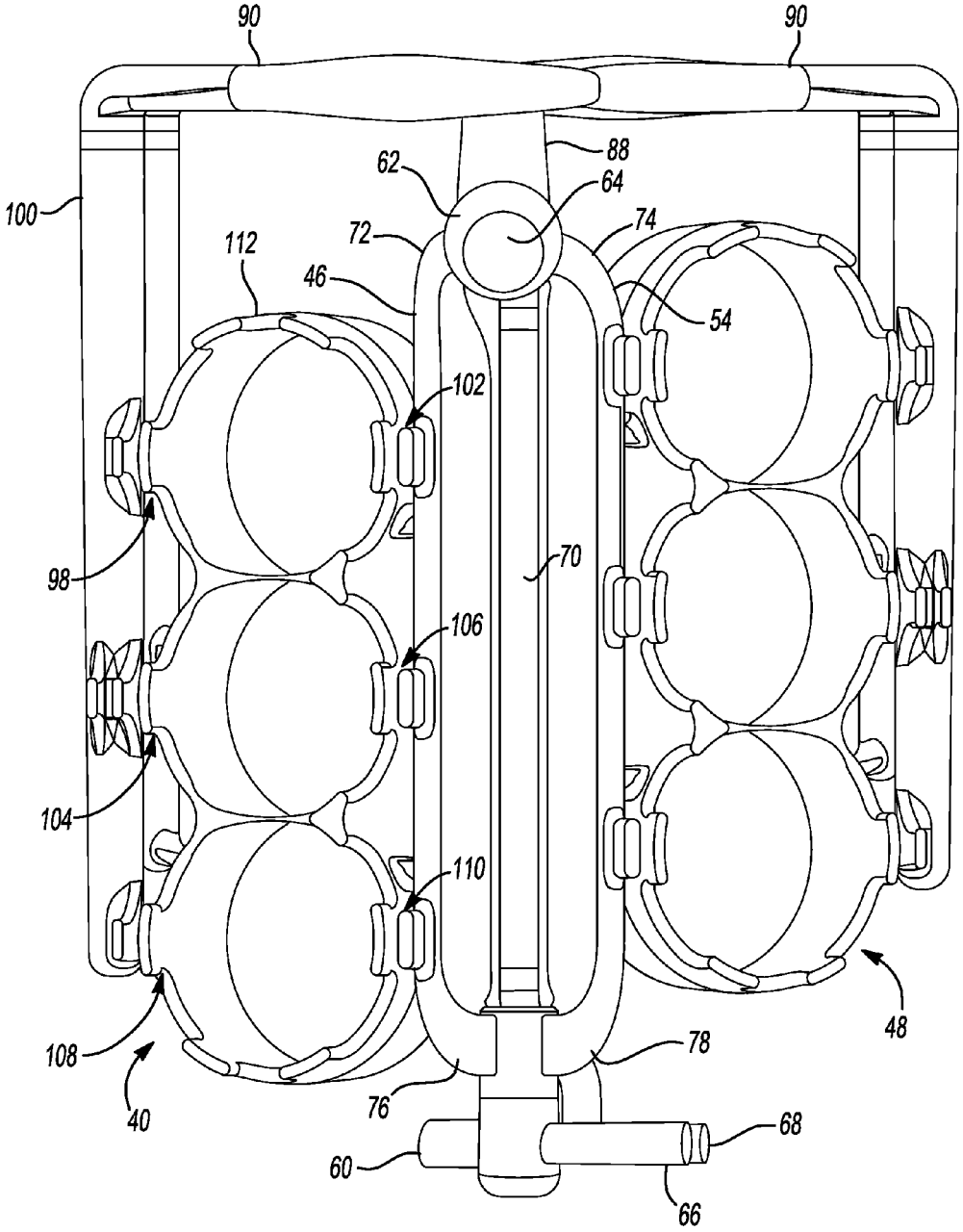
FIG. 4 is an illustration of a portion of the coolant passages shown in FIG. 3.

With additional reference to FIGS. 3 and 4, the engine structure 12 may define a first cooling jacket 40 associated with the first set of cylinders 18, 20, 22 and a first cooling jacket inlet 42, a first cooling jacket outlet 44 and a first coolant return gallery 46 in fluid communication with the first cooling jacket 40. Similarly, the engine structure 12 may define a second cooling jacket 48 associated with the second set of cylinders 24, 26, 28 and a second cooling jacket inlet 50, a second cooling jacket outlet 52 and a second coolant return gallery 54 in fluid communication with the second cooling jacket 48. In the present non-limiting example, the first and second cooling jacket inlets 42, 50, the first and second cooling jacket outlets 44, 52 and the first and second coolant return galleries 46, 54 are each defined in the engine block 16. The first and second coolant return galleries 46, 54 may be in the form of cast passages within the engine block 16 and may extend in a longitudinal direction from a first longitudinal end 56 of the engine structure 12 to a second longitudinal end 58 of the engine structure 12.

The engine structure 12 may additionally define a radiator supply feed 60, a radiator bypass feed 62, a thermostat housing 64, a heater core supply feed 66, a heater core return feed 68 and a heater core return gallery 70. The radiator bypass feed 62 and the thermostat housing 64 may each be located at the first longitudinal end 56 of the engine structure 12. The radiator supply feed 60, the heater core supply feed 66 and the heater core return feed 68 may each be located at the second longitudinal end 58 of the engine structure 12.

More specifically, in the present non-limiting example, the radiator bypass feed 62 and the thermostat housing 64 are each in fluid communication with and located at first longitudinal ends 72, 74 of the first and second coolant return galleries 46, 54 and the radiator supply feed 60 and the heater core supply feed 66 are each in fluid communication with and located at second longitudinal ends 76, 78 of the first and second coolant return galleries 46, 54. The first cooling jacket outlet 44 may extend to a central region of the first coolant return gallery 46 longitudinally between the first longitudinal end 72 and the second longitudinal end 76. Similarly, the second cooling jacket outlet 52 may extend to a central region of the second coolant return gallery 54 longitudinally between the first longitudinal end 74 and the second longitudinal end 78.

The heater core return feed 68 may be in communication with the heater core return gallery 70. The heater core return gallery 70 may be defined in the engine block 16 below the first and second coolant return galleries 46, 54 and may extend in the longitudinal direction from the heater core return feed 68 (second longitudinal end 58) toward the first longitudinal end 56 of the engine structure 12.

The cooling system 14 may include a coolant pump 80 in fluid communication with a coolant fluid, a thermostat 82, a radiator 84 and a heater core 86. The coolant pump 80 may be located at the first longitudinal end 56 of the engine structure 12 and defines a pump inlet 88 and a pump outlet 90. The pump inlet 88 may be in fluid communication with and located at the first longitudinal ends 72, 74 of the first and second coolant return galleries 46, 54. More specifically, the radiator bypass feed 62 may be in communication with the pump inlet 88. The pump inlet 88 may also be in fluid communication with the heater core return gallery 70. The simplified casting arrangement provided by the first and second coolant return galleries 46, 54 and the heater core return gallery 70 allows for more gradual transitions in the passages to minimize pump cavitation.

The thermostat 82 may be located at the first longitudinal end of the engine structure 12 within the thermostat housing 64 and in communication with the radiator 84 and the pump inlet 88. More specifically, the thermostat 82 may be in fluid communication with and located at the first longitudinal ends 72, 74 of the first and second coolant return galleries 46, 54.

The radiator 84 may be in communication with the radiator supply feed 60 and the thermostat 82. The heater core 86 may be in communication with the heater core supply feed 66 and the heater core return feed 68.

In the present non-limiting arrangement, the first and second cooling jackets 40, 48 may define parallel flow paths laterally across the engine structure 12. The first and second cooling jackets 40, 48 may be similar to one another. Therefore, the first cooling jacket 40 will be described for simplicity with the understanding that the description applies equally to the second cooling jacket 48.

The first cooling jacket 40 may include a first region 92 associated with the first cylinder 18, a second region 94 associated with the second cylinder 20 and a third region 96 associated with the third cylinder 22. The first region 92 may define a first coolant inlet 98 in communication with the pump outlet 90 via a first coolant supply gallery 100 and a first outlet 102 in communication with the first coolant return gallery 46. The second region 94 may define a second coolant inlet 104 in communication with the pump outlet 90 via the first coolant supply gallery 100 and a second outlet 106 in communication with the first coolant return gallery 46. The third region 96 may define a third coolant inlet 108 in communication with the pump outlet 90 via the first coolant supply gallery 100 and a third outlet 110 in communication with the first coolant return gallery 46. The first, second and third regions 92, 94, 96 may define a parallel flow arrangement laterally across the engine structure 12 from the pump outlet 90 to the first coolant return gallery 46.

The first, second and third regions 92, 94, 96 may also be similar to one another. Therefore, the first region 92 will be described for simplicity with the understanding that the description applies equally to the second and third regions 94, 96. The cylinder head 30 may define a first set of ports including intake and exhaust ports 32, 34 in communication with the first cylinder 18. The first region 92 may include a first cylinder cooling jacket 112 defined in the engine block 16 at an outer periphery of the first cylinder 18 and a first port cooling jacket 114 defined in the cylinder head for the first set of ports. The first port cooling jacket 114 may define a first head coolant flow path in a parallel flow arrangement with a coolant flow path defined by the first cylinder cooling jacket 112.

During operation, the first coolant return gallery 46 and the second coolant return gallery 54 may each form a radiator bypass passage providing the coolant fluid to the coolant pump 80 and bypassing the radiator 84 during a first operating condition. The first coolant return gallery 46 and the second coolant return gallery 54 may each form a radiator supply passage providing the coolant fluid to the radiator 84 during a second operating condition. In the present non-limiting example, the first operating condition includes the thermostat 82 being in a closed position preventing coolant fluid flow through the radiator 84 and the second operating condition includes the thermostat 82 being open and allowing coolant fluid flow through the radiator 84. The coolant fluid may flow in a first direction (D1) within the first and second coolant return galleries 46, 54 during the first operating condition to bypass the radiator 84 (FIG. 1) and may flow in a second direction (D2) within the first and second coolant return galleries 46, 54 opposite the first direction (D1) during the second operating condition to provide flow through the radiator 84 (FIG. 2). The first direction (D1) may be defined from the second longitudinal end 58 of the engine structure 12 toward the first longitudinal end 56 of the engine structure 12.

What is claimed is:

1. An engine assembly comprising:

a coolant pump in communication with a coolant fluid and including a pump inlet and a pump outlet;

a V-configuration engine structure including a V-configuration engine block and a pair of cylinder heads mounted to opposite sides of the engine block, the V-configuration engine structure defining:

a first set of cylinders along a first bank of the engine block and a second set of cylinders along a second bank of the engine block, the first bank and the second bank defining a valley therebetween;

a first coolant return gallery defined by a first cast passage in the engine block and disposed in the valley and extending in a longitudinal direction from a first longitudinal end of the engine structure to a second longitudinal end of the engine structure;

a second coolant return gallery defined by a second cast passage in the engine block and disposed in the valley and extending in the longitudinal direction from the first longitudinal end of the engine structure to the second longitudinal end of the engine structure; and a first cooling jacket associated with the first set of cylinders including a first cooling jacket inlet in communication with the pump outlet and a first cooling jacket outlet in communication with the first coolant return gallery;

a second cooling jacket associated with the second set of cylinders including a second cooling jacket inlet in communication with the pump outlet and a second cooling jacket outlet in communication with the second coolant return gallery; and a radiator supply feed in communication with the first coolant return gallery and the second coolant return gallery and configured to provide the coolant fluid to a radiator; and a radiator bypass feed in communication with the first coolant return gallery, the second coolant return gallery, and the pump inlet, the first coolant return gallery and the second coolant return gallery each forming a radiator bypass passage providing the coolant fluid to the coolant pump and bypassing the radiator during a first operating condition and forming a radiator supply passage providing the coolant fluid to the radiator during a second operating condition; and wherein the first set of cylinders includes a first cylinder and a second cylinder and the first cooling jacket includes a first cylindrical region surrounding the first cylinder and a second cylindrical region surrounding the second cylinder, the first cylindrical region defining a first coolant inlet on a first side of the first cylindrical region and in communication with the pump outlet and a first outlet on an opposite side of the first cylindrical region from the first side and in communication with the first coolant return gallery, the second cylindrical region defining a second coolant inlet on a first side of the second cylindrical region and in communication with the pump outlet and a second outlet on an opposite side of the second cylindrical region from the first side and in communication with the first coolant return gallery, the first and second cylindrical regions defining a parallel flow arrangement laterally across the engine structure from the pump outlet to the first coolant return gallery.

2. The engine assembly of claim 1, further comprising a thermostat in communication with the first coolant return gallery, the second coolant return gallery and the coolant pump.

3. The engine assembly of claim 1, wherein the engine assembly defines a heater core supply feed in communication with the first coolant return gallery and the second coolant return gallery, located at the second longitudinal end and providing the coolant fluid to a heater core, a heater core return feed located at the second longitudinal end and receiving the coolant fluid from the heater core, and a heater core return gallery extending in the longitudinal direction from the second longitudinal end to the first longitudinal end.

4. The engine assembly of claim 3, wherein the heater core return gallery is located below the first coolant return gallery and the second coolant return gallery in the engine structure.

5. The engine assembly of claim 1, wherein the coolant pump is located at the first longitudinal end of the engine structure.

6. The engine assembly of claim 5, further comprising a thermostat located at the first longitudinal end of the engine structure and in communication with the pump inlet.

7. An engine assembly comprising:

a coolant pump in communication with a coolant fluid and including a pump inlet and a pump outlet;

a V-configuration engine structure including a V-configuration engine block and a pair of cylinder heads mounted to opposite sides of the engine block, the V-configuration engine structure defining:

a first set of cylinders along a first bank of the engine block and a second set of cylinders along a second bank of the engine block, the first bank and the second bank defining a valley therebetween;

a first coolant return gallery defined by a first cast passage in the engine block and disposed entirely in the valley and extending in a longitudinal direction from a first longitudinal end of the engine structure to a second longitudinal end of the engine structure;

a second coolant return gallery defined by a second cast passage in the engine block and disposed entirely in the valley and extending in the longitudinal direction from the first longitudinal end of the engine structure to the second longitudinal end of the engine structure; and a first cooling jacket associated with the first set of cylinders, the first cooling jacket including a plurality of first cylindrical regions each surrounding one of the first set of cylinders and including a first plurality of first cooling jacket inlets each in communication with the pump outlet on a first side of the plurality of first cylindrical regions and a plurality of first cooling jacket outlets each in communication with the first coolant return gallery on a second side of the plurality of first cylindrical regions opposite the first side of the plurality of first cylindrical regions, the plurality of first cylindrical regions defining a parallel flow arrangement laterally across the engine structure from the pump outlet to the first coolant return gallery;

a second cooling jacket associated with the second set of cylinders, the second cooling jacket including a plurality of second cylindrical regions each surrounding one of the second set of cylinders and including a second plurality of second cooling jacket inlets each in communication with the pump outlet on a first side of the plurality of second cylindrical regions and a plurality of second cooling jacket outlets each in communication with the second coolant return gallery on a second side of the plurality of second cylindrical regions opposite the first side of the second plurality of cylindrical regions, the plurality of second cylindrical regions defining a parallel flow arrangement laterally across the engine structure from the pump outlet to the second coolant return gallery; and a radiator supply feed in communication with the first coolant return gallery and the second coolant return gallery configured to provide the coolant fluid to a radiator; and a radiator bypass feed in communication with the first coolant return gallery, the second coolant return gallery, and the pump inlet, the first coolant return gallery and the second coolant return gallery each forming a radiator bypass passage providing the coolant fluid to the coolant pump and bypassing the radiator during a first operating condition and forming a radiator supply passage providing the coolant fluid to the radiator during a second operating condition;

wherein the pair of cylinder heads each define a first set of ports in communication with the first set of cylinders and the second set of cylinders, the first set of cylinders including a first cylinder and the first cooling jacket including the plurality of first cylindrical regions defined in the engine block at an outer periphery of the first cylinder and a first port cooling jacket defined in the cylinder head for the first set of ports, the first port cooling jacket including a plurality of first port cooling jacket inlets each in communication with the PUMP outlet on the first side of the plurality of first cylindrical regions and a plurality of first port cooling jacket outlets each in communication with the first coolant return gallery on the second side of the first plurality of cylindrical regions and defining a first head coolant flow path in a parallel flow arrangement with a coolant flow path defined by the plurality of first cylindrical regions.

* * * * *